United States Patent [19]

Best

[11] 4,405,016

[45] Sep. 20, 1983

[54] UNDERWATER CHRISTMAS TREE CAP AND LOCKDOWN APPARATUS

[75] Inventor: Michael J. A. Best, Dursley, England

[73] Assignee: Smith International, Inc., Newport Beach, Calif.

[21] Appl. No.: 278,359

[22] Filed: Jun. 29, 1981

[30] Foreign Application Priority Data

Dec. 18, 1980 [GB] United Kingdom ..... 8040496

[51] Int. Cl.[3] ..... E21B 41/04; E21B 43/013; E21B 43/017

[52] U.S. Cl. ..... 166/337; 166/340; 166/344; 166/347; 166/341

[58] Field of Search ..... 166/344, 338–340, 166/341, 351, 368, 86, 87, 243, 346, 347, 337

[56] References Cited

U.S. PATENT DOCUMENTS

| | | | |
|---|---|---|---|
| 3,222,088 | 12/1965 | Haeber | 166/344 X |
| 3,321,217 | 5/1967 | Ahlstone | 166/338 X |
| 3,325,190 | 6/1967 | Eckert et al. | 166/344 X |
| 3,710,859 | 1/1973 | Hanes et al. | 166/344 X |

FOREIGN PATENT DOCUMENTS

| | | | |
|---|---|---|---|
| 2024919 | 1/1980 | United Kingdom | 166/344 |

*Primary Examiner*—Stephen J. Novosad
*Assistant Examiner*—Thuy M. Bui
*Attorney, Agent, or Firm*—Murray Robinson; David Alan Rose; William E. Shull

[57] ABSTRACT

A cap for an underwater Christmas tree having locking probes to lock down the operating rods of a connector connecting the Christmas tree to an underwater wellhead housing. The tops of the operating rods are housed within hollow canisters at the top of the Christmas tree.

The cap includes a body having circumferentially disposed locking dogs housed therein for engagement with the top of the Christmas tree. The dogs are actuated by a cam ring which telescopically receives the body and has a tapered surface for sliding over a correlatively tapered surface on each of the dogs. The body includes a metal gasket seal for sealing engagement with the top of the Christmas tree, and seals are provided between the cam ring and body.

The cap has downwardly extending locking probes which extend telescopically into the canisters above the operating rods. The locking probes each include a housing and a releasable tubular piston slidably disposed in the housing. The piston is biased in a downward direction, and is held in a cocked or loaded raised position prior to release by a trigger held in engagement with the piston and housing by a pin on a running tool telescopically slidably disposed in the piston. The piston is released by removal of the pin, which cams the trigger out of engagement with the housing. Upon release the piston is biased into engagement with the rod. The piston is provided with locking dogs which engage the walls of the housing and prevent upward movement of the piston and rod after release of the piston.

28 Claims, 9 Drawing Figures

1
29
37
28
33
27
31
35
25
41
21
23
15
43
17
39
11
13
7
9
10
12
19
3
5

15
147
135
137
143
145
131
133
167
169
165
162
161
139
163
153
149
155
151
157
159
45

UNDERWATER CHRISTMAS TREE CAP AND LOCKDOWN APPARATUS

TECHNICAL FIELD

The present invention relates generally to underwater wellhead caps and connectors, and more particularly to a cap for an underwater Christmas tree for capping the Christmas tree and for locking down the connector which secures the Christmas tree to an underwater wellhead housing.

BACKGROUND ART

Various connectors have been employed in the past for connecting an underwater Christmas tree to an underwater wellhead housing. One such device includes radially slidable locking dogs circumferentially disposed in the tubular base of the Christmas tree for engagement with the top of the wellhead housing. The locking dogs are radially outwardly spring biased and are actuated by an annular sleeve disposed around the locking dogs. The sleeve has an interior tapered surface for engaging a correlatively tapered exterior surface of the locking dogs such that upward movement of the sleeve permits the dogs to move further radially outward by spring action out of engagement with the wellhead housing, and downward movement of the sleeve wedges the dogs further radially inward into engagement with the wellhead housing.

Such connectors were often actuated hydraulically. However, the maintenance of hydraulic actuators over prolonged periods of time was uncertain and unreliable due to adverse environmental conditions. A premature release of the Christmas tree would be a severe problem. Hydraulic connectors have in some cases been replaced by mechanical operators. Such an operator can include operating rods connected to and extending upwardly from the sleeve for actuating the sleeve. Pulling upward on the rods pulls the sleeve upward with it to release the dogs, and pushing downward on the rods pushes the sleeve downward with it to actuate the dogs.

Hydraulically actuated devices connected to the operating rod have generally been used for actuating the rods and, hence, the sleeve and locking dogs. Such devices remain on the rods at the ocean floor and are subject to the same adverse environmental conditions, such as the corrosive action of salt or other minerals, as the hydraulic connectors, which sometimes render them inoperable. As a result, removal of the tree from the well, e.g. for repairs to the tree or to the well, can become difficult or impossible without costly and sometimes dangerous repairs.

To eliminate the problems associated with use of such hydraulically actuated devices, the rods have sometimes been provided with mechanical means, such as an annular notch in the rod, to which a tool lowered from the surface can attach for securely gripping the rod so that it can be pulled upward by the tool to allow the dogs to be released from engagement with the wellhead housing. Such a tool also is used to push the rods downward to connect the tree to the wellhead housing.

A problem exists with use of such mechanical means on the rods for actuating the rods. Due to jarring from production or other operations, or to environmental conditions such as currents or thermal cycles, there is a tendency of the rods to creep upward, thereby loosening the connection between the Christmas tree and the wellhead housing and possibly allowing premature release of the tree from the wellhead housing. It is necessary, therefore, to keep the rods from moving upward so that the connection between the Christmas tree and the wellhead housing remains tight. Furthermore, the connection of the tree to the wellhead housing is generally undertaken remote from observers or operators, with relatively large tolerances for the interconnecting parts, and under adverse environmental conditions. As a result, there is an uncertainty as to the exact vertical position of the rods after connection of the tree to the wellhead housing is complete, making the locking down of the rods more difficult. The rods must be locked down at whatever vertical position they are in after connection of the tree to the wellhead housing has been completed.

Other objects and advantages of the invention will appear from the following description.

SUMMARY OF THE INVENTION

The present invention is an apparatus for capping a Christmas tree connected to the wellhead housing of an underwater well and for maintaining the connection between the tree and housing. A connector having locking dogs reciprocably mounted thereon is disposed on the lower end of the Christmas tee for telescopically receiving the upper end of the housing. The locking dogs are actuated by an annular sleeve disposed therearound by a camming movement caused by correlatively tapered surfaces on the dogs and sleeve. Upwardly extending rods are disposed on the sleeve and have their upper ends projected into canisters disposed around the upper end of the Christmas tree.

A cap, mounted on a running tool, has dog segments mounted therein for engagement with the top of the Christmas tree upon the lowering of the cap by the running tool over the top of the Christmas tree. A cam ring actuates the dog segments. Appropriate seals and valves are provided for sealing the connection between the cap and Christmas tree and testing the seals.

The cap has probes mounted thereon which are received within the canisters on the top of the Christmas tree. These probes have pistons which can be extended from the probes into engagement with the tops of the rods upon release. To release the pistons, latches are disengaged to permit the biasing of the pistons downward to engage the rods. Dogs are provided within the probes to lock the pistons into the engaged position. Such pistons will engage the rods without regard to a difference in the vertical positions of the tops of the rods.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DESCRIPTION OF THE PREFERRED EMBODIMENT

Figure 1:
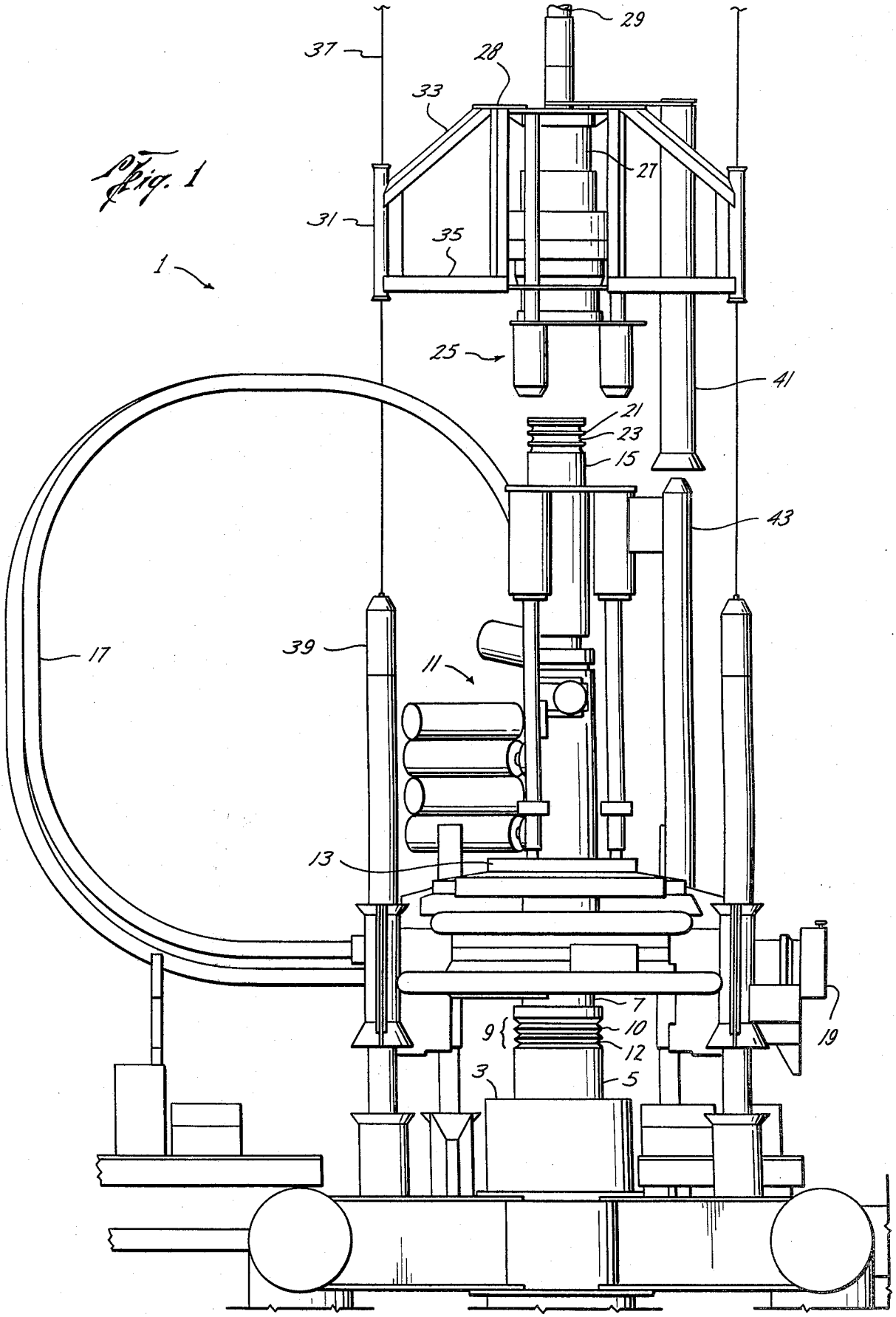
FIG. 1 is an elevation, partially schematic, illustrating underwater wellhead apparatus including a Christmas tree, with the tree cap of the present invention being lowered by its running tool into place on top of the Christmas tree.

Referring initially to FIG. 1, there is shown generally at 1 apparatus comprising a portion of an underwater wellhead which is typically disposed at or near the bottom of a body of water for use in production of oil and gas from beneath such body of water. Underwater wellhead apparatus 1 includes an outer, large diameter tubular wellhead housing 3 within which are disposed inner, progressively smaller diameter tubular wellhead housings such as those shown at 5, 7. The inside diameter of the outer housing 3 may be 30 inches, for example, and the inside diameters of the inner housings 5, 7 may be, for example, 20 inches and 13⅝ inches, respectively. Production casing and other tubing strings may extend from or through these wellhead housings into the floor of the body of water and down into the well bore to the zones from which the oil and gas are produced.

Wellhead housing 5 is provided with a ribbed portion 9 on its outer surface near its upper end, including annular no-lead (i.e., substantially zero pitch) ribs 10 and grooves 12 therebetween, adapted for mating interconnection with other wellhead equipment carrying corresponding interfitting grooves and ribs. Ribs 10 are substantially of the same outside diameter as the portions of wellhead housing 5 adjacent to the ribbed portion 9. Wellhead housing 7 is similarly provided with a ribbed portion (not shown) on its outer surface near its upper end.

Underwater wellhead apparatus 1 also includes a Christmas tree, indicated generally at 11, which is attached at its base to the top of wellhead housing 7 by a mechanical connector, indicated generally at 13. Mechanical connector 13 and its operating rods are shown in greater detail in FIGS. 2A and 2B. The upper portion of Christmas tree 11 includes a wye spool 15 having a vertical bore in communication with the well bore for providing access to the well from the surface, for example, for installing and retrieving wireline tools, and a side bore disposed at an angle to and in communication with the vertical bore to which tubular flow loops 17 are connected and through which flows the oil and/or gas produced from the well. Flow loops 17 may be connected through various flow control devices and systems, not shown, such as choke nipples, to flowline hub 19. Oil and/or gas produced from the underwater well is carried through the flow loops 17 to flowline hub 19, from which it can be transported immediately to the surface of the body of water or to some other location for gathering or storage with oil and/or gas from other wells, for eventual transportation to the surface.

The outside surface of the upper portion of wye spool 15 is provided with a plurality of annular ribs 21 and grooves 23 therebetween, comprising substantially no-lead threads adapted for mating interconnection with interfitting grooves and ribs disposed on the tree cap of the present invention, indicated generally at 25.

Tree cap 25 of the present invention is shown in FIG. 1 being lowered into place on the top of Christmas tree 11, carried by its running tool 27 attached to drill pipe 29. Tree cap running tool 27 includes guide sleeves 31 attached to a guide frame 28 having upper and lower struts 33, 35, respectively. Guide lines 37 run through guide sleeves 31, are attached to guide posts 39 at the wellhead and extend to the platform or vessel at the surface of the body of water to provide guidance for the transportation of tools and equipment back and forth between such surface and the wellhead. Tree cap running tool 27 also includes a landing sleeve 41 which telescopically receives a landing post 43 connected to tree 11 when running tool 27 lands at the wellhead in order to aid in proper alignment of tree cap 25 with respect to tree 11 during installation of the cap on top of the tree.

The Christmas tree 11 shown in FIG. 1 is of a type used with an underwater manifold center. Several wells are typically located around the manifold center. The wells are drilled into the floor of the body of water through the manifold center, and the Christmas trees are set in place on the wells around it. The Christmas trees are all connected into the manifold center. A manifold tree as is shown in FIG. 1 will typically have a wye spool, e.g., as shown at 15, as its top member. A satellite tree, i.e., one that sits off by itself on the floor of the body of water, will typically have additional valves on top of the wye spool, with a member known as a mandrel as its top member. It should be understood, however, that use of the tree cap of the present invention is not limited to manifold trees; the tree cap of the present invention can be used with any type of tree having a top member, be it a wye spool, mandrel or some other member, to which the tree cap can attach.

Figure 2A:
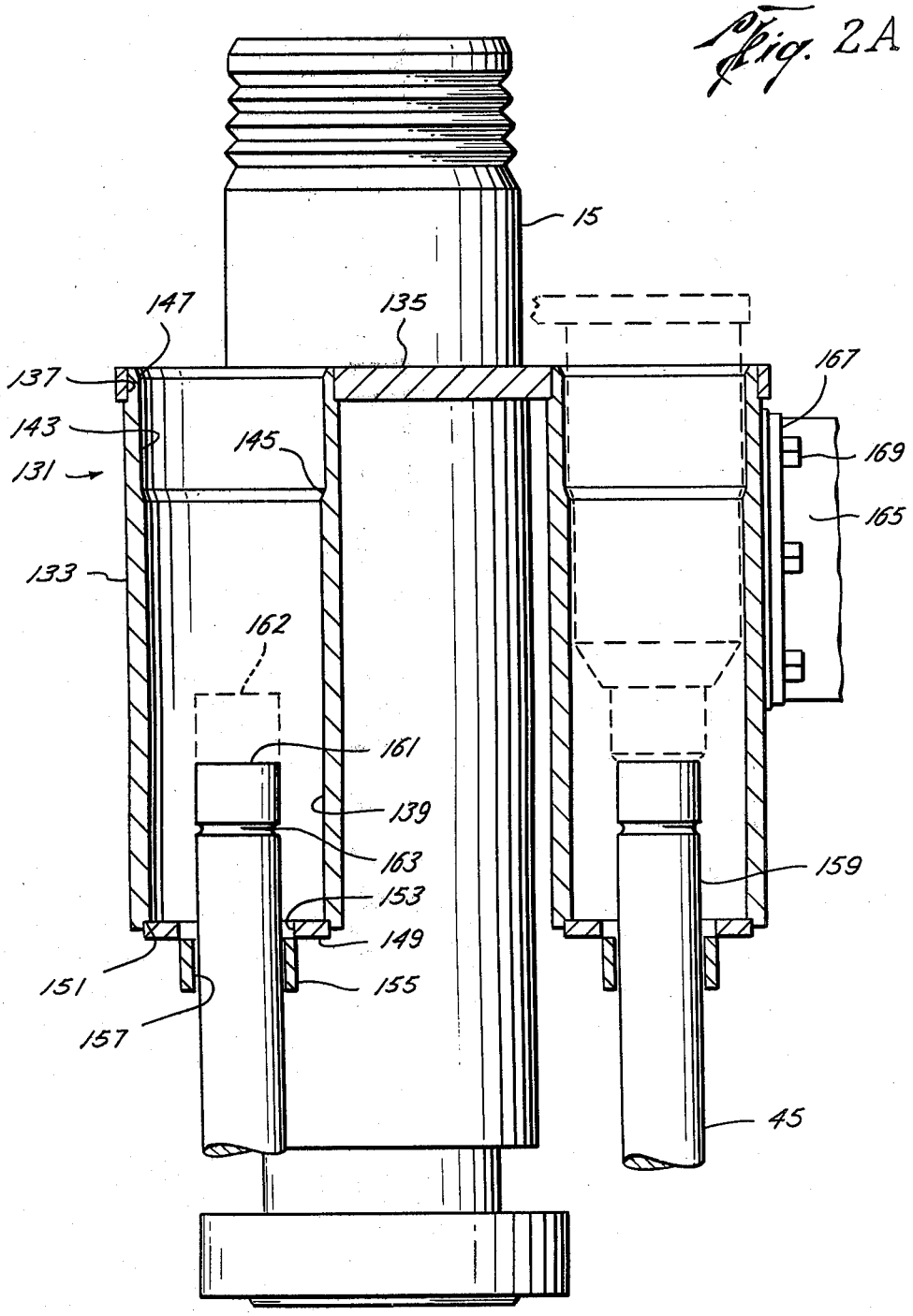
FIG. 2A is a view, partially in section and partially in elevation, of the wye spool portion of the Christmas tree of FIG. 1 and the interface frame and canisters attached thereto in which are housed the tops of the rods which operate the mechanical connector at the tree base.
Figure 2B:
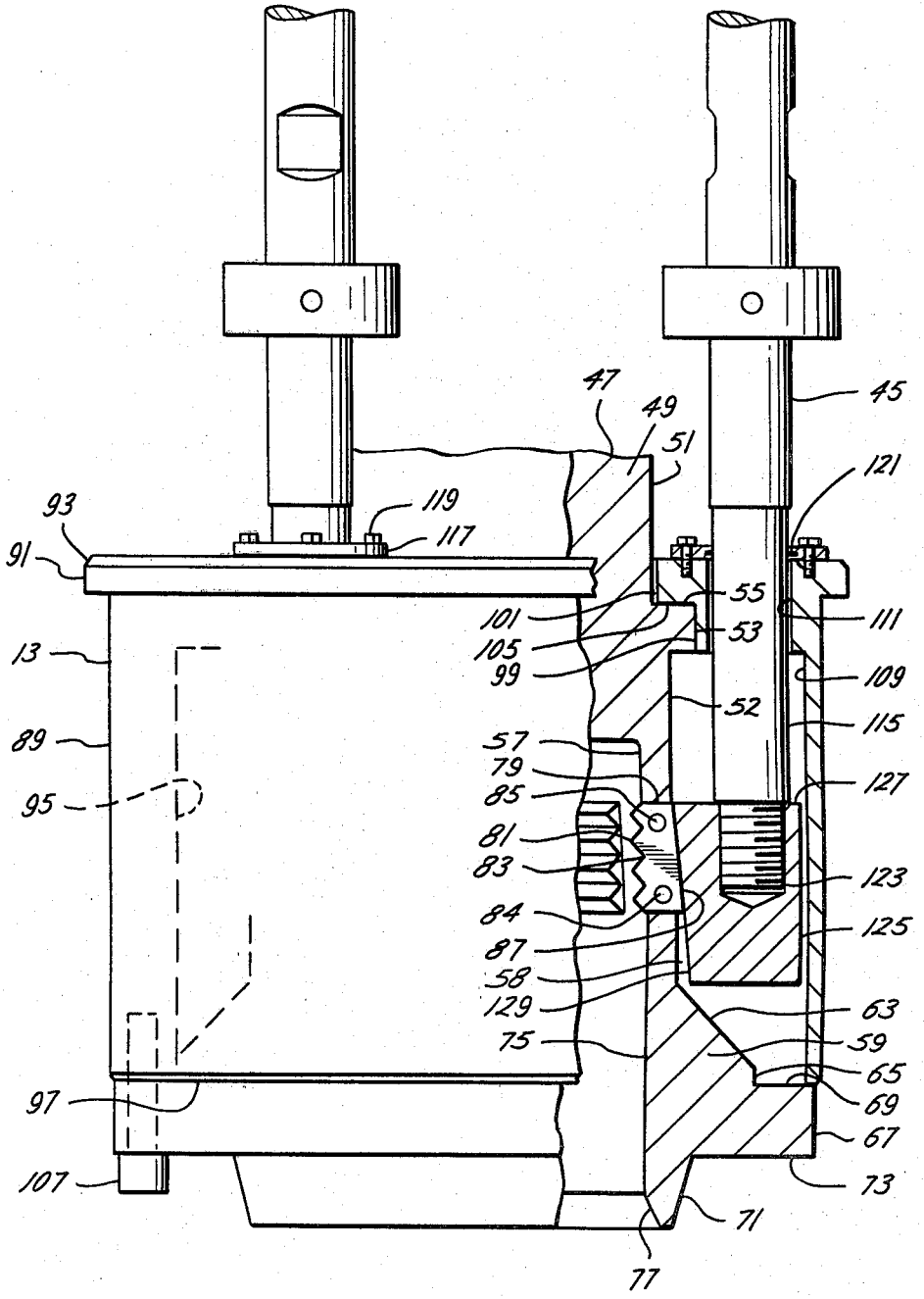
FIG. 2B is a view, partially in section and partially in elevation, of the mechanical connector and associated operating rods which connects the Christmas tree at its base to the underwater wellhead housing.

Referring now to FIG. 2B, there are shown the mechanical connector 13 and rods 45 which operate the mechanical connector. The mechanical connector 13 connects Christmas tree 11 to the top of wellhead housing 7. The base 47 of Christmas tree 11 includes an upper cylindrical member 49 having an upper portion 51 and a lower portion 52 with portion 52 having an outside diameter greater than portion 51. Between upper portion 51 and lower portion 52, there is an annular flange 53 forming shoulder 55. Lower portion 52 has a central bore 57 in communication and coaxial with an upper reduced diameter bore in upper portion 51. Base 47 of Christmas tree 11 also includes a lower member 59 having an upper cylindrical portion 58, a frustoconical portion 63 below upper portion 58, intermediate and lower portions 65, 67 below frustoconical portion 63, and a frustoconical portion 71 below portion 67. An annular shoulder 69 is formed between portions 65, 67, and an annular shoulder 73 is formed between portions 67, 71. Upper portion 58, frustoconical portion 63, intermediate and lower portions 65, 67, and frustoconical portion 71 have a common central bore 75 therethrough, which is coaxial with bore 57 of upper member 48. Frustoconical portion 71 includes a conical shoulder 77 at its lower end extending to the bottom of base 47.

Base 47 of Christmas tree 11 also includes a set of circumferentially disposed dog segments 79 housed in a recess between upper and lower members 49, 59. Dog segments 79 have annular ribs 81 and grooves 83 therebetween on their inner faces for mating interconnection with interfitting ribs and grooves on the outside surface of wellhead housing 7. Dog segments 79 each have a pair of transverse blind passages 84 on each side in communication with and coaxially aligned with corresponding blind passages on the adjacent dog segments, and in which are disposed a pair of coil springs 85 maintained in compression. Springs 85 exert a force normal to the adjacent surfaces of the dog segments, which lie in radial planes, and tend to force the dog segments radially outward. The outer surface 87 of the dog segments 79 is frusto-conical in configuration, tapering outwardly from the top of the dog segments downward.

Mechanical connector 13 includes a cylindrical body 89 with an annular, outwardly extending flange 91 at its upper end. The upper outside surface of flange 91 is beveled, at 93.

Cylindrical body 89 has a lower central bore 95 extending from the lower end 97 of body 89 to bore 99. Bore 99 extends from bore 95 to bore 101. Bores 99 and 101 form annular shoulder 105. Bore 101 is of larger diameter than the outside diameter of upper portion 51 of member 49 of tree base 47. The outside diameter of flange 53 is substantially the same as the diameter of bore 99 to provide a mating fit. The distance between annular shoulder 105 and the lower end 97 of body 89 is substantially the same as the distance between annular shoulders 55, 69 of tree base 47. Annular shoulder 105 of mechanical connector body 89 rests on shoulder 55 of tree base 47, and end 97 of body 89 rests on annular shoulder 69 of tree base 47. Body 89 of mechanical connector 13 is secured to tree base 47 by bolts 107 which extend through cylindrical portion 67 of tree base 47 and are threaded into body 89 of mechanical connector 13.

At each of three equally circumferentially spaced apart locations around the interior surface of bore 95 of body 89, there is a longitudinal, semicircular-shaped groove or channel 109 extending the length of bore 95. At each of such three locations, holes 111 extend from the top of body 89 into channels 109. Holes 111 receive the lower portions 115 of operating rods 45 for insertion into channels 109. A seal plate 117 is mounted on top of flange 91 around each of the three mechanical connector operating rods 45, by bolts 119. A seal ring 121 is mounted within an annular groove around the inner face of seal plate 117 for sealingly engaging the operating rods 45 to prevent corrosive sea water or other fluids from entering channels 109 and bore 95.

The lower portion 115 of rod 45 has a threaded bottom end 123 for threadedly engaging an annular sleeve 125 mounted in bore 95. Sleeve 125 has three radially outwardly extending, semicircular-shaped projections 127 at the circumferential positions corresponding to longitudinal channels 109. The outer surface of sleeve 125 between projections 127 is of generally circular cylindrical configuration. Sleeve 125 has a frustoconical inner surface 129 correlatively shaped, i.e. having the same taper, to that of frustoconical surface 87 of dog segments 79. Surface 129 tapers outwardly from the top of sleeve 125 downward. Inner surface 129 of sleeve 125 bears upon and is slidably movable across surface 87 of dog segments 79. When rods 45 are moved upward, sleeve 125 attached thereto also moves upward in bore 95, projections 127 being disposed in channels 109, such that the larger inner diameter portions of surface 129 bear upon the dog segments 79, thereby allowing the springs 85 disposed between each pair of dog segments to force the dog segments further radially outward. When rods 45 are moved downward, sleeve 125 also moves downward within bore 95 and wedges the dog segments further radially inward, the smaller inner diameter portions of surface 129 being made to bear upon the dog segments. Thus, by moving rods 45 up or down, sleeve 125 connected to the rods also moves up or down, respectively, along with the rods, thereby actuating the dog segments 79 and allowing dog segments 79 to move radially outward by spring action or forcing the dog segments to move radially inward, respectively.

Referring to FIG. 2A, an interface frame indicated generally at 131 is shown disposed on wye spool 15 of Christmas tree 11. Interface frame 131 includes a flange plate 135 of generally triangular configuration with a central opening therein for receiving the body of wye spool 15. Flange plate 135 is rigidly attached to wye spool 15, as by welding. Flange plate 135 has three holes 137 therethrough, one hole at each of its corners, in each of which is disposed the top of a hollow cylindrical canister 133. Canisters 133 are attached to flange plate 135 at holes 137, as by welding. Canisters 133 each have a lower cylindrical bore 139 extending along a large portion of their length, above which bore 139 is cylindrical counterbore 143 which creates a frustoconical shoulder 145 therebetween. At the upper end of counterbore 143 of each of canisters 133 there is a frustoconical shoulder 147. An annular end plate 149 is disposed in a groove 151 around the lower inner periphery of each of canisters 133 and is attached to the canisters, as by welding. End plate 149 has a central opening 153 therethrough. A downwardly extending collar 155 is attached to the lower surface of each of the end plates 149. Collars 155 each have a bore 157 therethrough which bore is coaxial with and smaller than the opening 153 in end plate 149.

The upper end 159 of rod 45 extends through bore 157 and opening 153 and is disposed within bore 139 of canisters 133. Near the top end 161 of rod 45 there is a circumferentially extending annular notch or groove 163 in the rod.

A generally rectangular plate 165 is attached to one of the canisters 133 by bolts 169 through a flange 167 at one end of plate 165. The other end of plate 165 is attached, as by bolts through a flange at the other end of the plate, to landing post 43 (FIG. 1).

Canisters 133 house the tops of the rods 45, and act as guides to keep the rods vertically aligned; that is, canisters 133 prevent the rods 45 from bending or from becoming vertically misaligned, as such bending or misalignment would render engagement for attachment or removal of tree 11 to or from wellhead housing 7 very difficult, if not impossible, from a remote location.

When it is desired to attach Christmas tree 11 to wellhead housing 7, the tree is affixed to a tree running tool (not shown) and lowered to the wellhead from the surface of the water or other location. In running position, the rods 45 are held in their uppermost position such that sleeve 125 will allow dog segments 79 to spread radially outward by spring action a sufficient distance to allow them to clear the ribs on top of the wellhead housing when the tree is lowered onto the wellhead housing, the top of the wellhead housing being then telescopically received within the bores 75, 57 of the tree base 47. When the tree 11 is seated on top of the wellhead housing 7, the ribs and grooves 81, 83 of dog segments 79 are disposed opposite interfitting grooves and ribs on the outer surface of the wellhead housing 7. The tree running tool then actuates the rods 45 by pushing them downward, typically by hydraulic power, thereby pushing sleeve 125 down over dog segments 79 and forcing them radially inward such that the ribs 81 on the dog segments 79 mate with the grooves on the upper end of the wellhead housing 7, and the ribs on the wellhead housing mate with the grooves on the dog segments. The tree running tool may then be removed to the surface of the water or elsewhere away from the tree, leaving the tree connected to the wellhead housing.

Since under normal circumstances the above tree connection operation is undertaken remote from observers or operators, and because of the large tolerances involved and the adverse environmental conditions such as corrosive action under which the operation occurs, there is an uncertainty as to the exact vertical position of the upper terminal ends 161 of rods 45 after they are pushed down and connection of the tree 11 to the wellhead housing 7 has been accomplished. The rods all may be at one unknown vertical position, or they may each be at a different vertical position due to skewing of sleeve 125. For example, upper end 161 of rod 45 could be at the vertical position 162 shown in phantom outline in FIG. 2A, or at the position shown in elevation or anywhere in between. Furthermore, there is a tendency of sleeve 125 to become loose due to jarring from production or other operations or from the adverse environmental conditions, e.g. currents, in which the tree operates. The tree cap of the present invention overcomes these problems by providing a positive lockdown for the operating rods at whatever vertical position they occupy after connection of the tree 11 to the wellhead housing 7 is complete, thereby preventing the sleeve from being shaken loose to weaken the connection of the tree to the wellhead housing.

When it is desired to remove the Christmas tree from the wellhead, e.g., for repairs or if the well is to be shut down, the tree cap of the present invention is removed from the top of the tree and the tree running tool is lowered to the tree. Grasping probes of the tree running tool are inserted into the tops of the canisters 133 and feel for and grip or attach themselves to the rods 45 at the notches 163. The rods are then pulled up by the tree running tool, typically hydraulically, which pulls up the sleeve 125 and releases the dog segments from mating interconnection with the wellhead housing and thereby releases the Christmas tree. The tree may then be removed from the wellhead.

Figure 3:
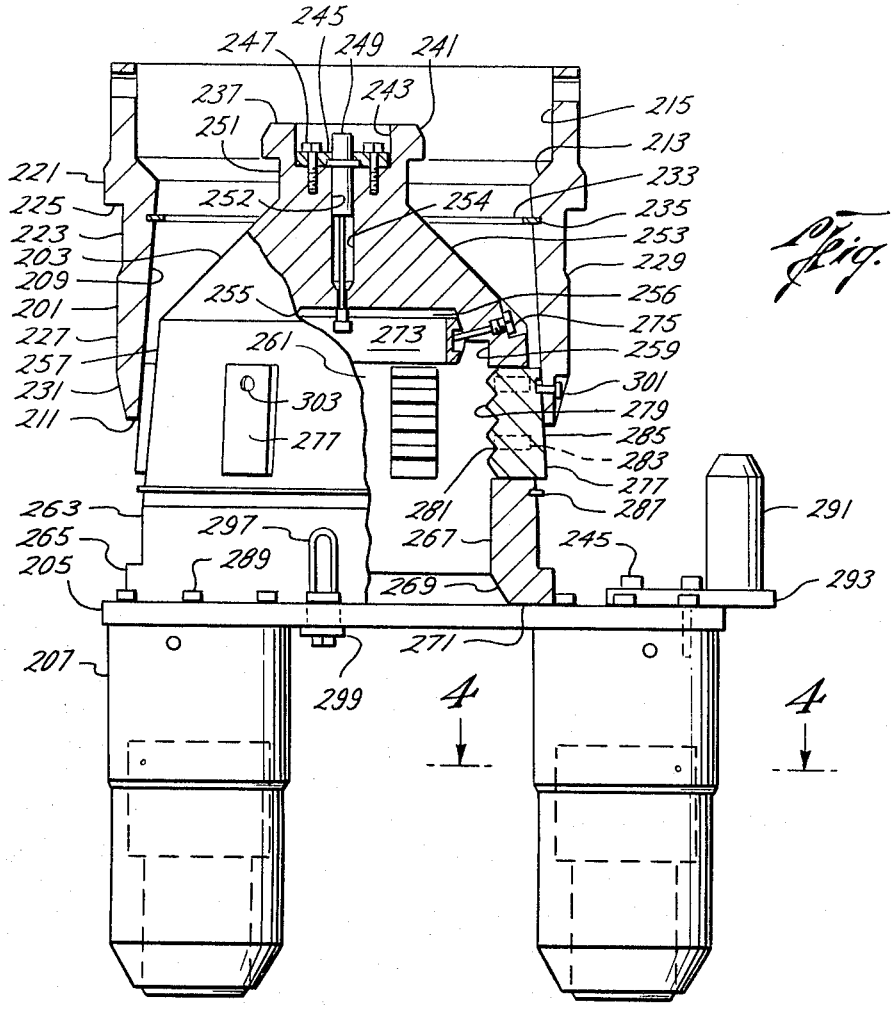
FIG. 3 is a view, partially in section and partially in elevation and with some parts broken away, of the tree cap of the present invention prior to its installation on top of the Christmas tree.

Referring now to FIG. 3, the tree cap 25 of the present invention includes a cam ring 201, a body 203, a base plate 205 and locking probes 207. Cam ring 201 has a lower internal frustoconical bore 209 and an upper cylindrical counterbore 215 creating shoulder 213. An O-ring type seal 233 is disposed in an inner annular groove 235 in bore 209 of cam ring 201. The outside surface of cam ring 201 is generally cylindrical having an annular flange 221 around its mid-portion. Below flange 221 of cam ring 201, there is a reduced diameter cylindrical portion 227 having a shallow annular channel 223 creating annular shoulder 225 and annular shoulder 229. Cam ring 201 has a lower frustoconical outer surface 231 extending from the bottom of cylindrical portion 227 to lower end 211 of cam ring 201.

Body 203 of tree cap 25 comprises a generally hollow machined forging having a cylindrical flange plate 237 at its top with a chamfered upper annular corner 241. Flange plate 237 has a bore 243 to receive a plate 245 secured to body 203 by bolts 247. The plate 245 has a central opening therethrough to receive a non-return valve 249. Body 203 includes a cylindrical neck 251 below flange plate 237, neck 251 having a central bore 252 therethrough in communication with the opening in plate 245 and through which non-return valve 249 extends. Below neck 251, body 203 has a frustoconical portion 253 with a central bore 254 in its upper portion coaxial with the bore 252 in neck 251 and through which non-return valve 249 also extends. The lower portion of frustoconical portion 253 has an internal blind bore 255 creating cavity 256. Below frustoconical portion 253 of body 203, body 203 has a second frustoconical portion 257 having less of a taper than frustoconical portion 53. Frustoconical portion 257 has an internal bore 259 creating a cavity 261 therewithin. Body 203 of tree cap 25 includes a hollow cylindrical portion 263 below frustoconical portion 257, with an outwardly extending annular flange 265 being disposed around the lower end of cylindrical portion 263. Cylindrical portion 263 of body 203 has an internal bore 267 continuous with bore 259 of frustoconical portion 257. A shoulder 269 extends from the lower end of bore 267 to the bottom end 271 of body 203. The bottom end 271 of body 203 is disposed on the upper surface of base plate 205. Body 203 is secured to base plate 205, as by welding.

A stainless steel AX-type ring gasket 273, which may be, for example, eleven inches in diameter, is held in place with the side of its upper lip against the sides of bore 255 by a set of four retaining bolts 275. Bolts 275 are threadedly disposed in passages extending through the wall of body 203, and engage the upper lip of gasket 273 such that a small degree of free movement of the gasket 273 is allowed.

Six dog segments 277 of generally rectangular shape are equally circumferentially spaced apart and disposed in correlatively shaped openings in the wall of frustoconical portion 257 of body 203. Dog segments 277 have ribs 279 and grooves 281 therebetween on their inner faces which are adapted to mate with interfitting grooves 23 and ribs 21 on the top of wye spool 15. Springs 283 disposed in blind channels in the sides of dog segments 277 exert a force normal to the adjacent radial-plane surface of the body 203 and tend to force dog segments 277 radially outward. The outside surface 285 of dog segments 277 is tapered correlatively to internal bore 209 of cam ring 201.

The internally tapered surface 209 of cam ring 201 bears upon the outside surfaces 285 of dog segments 277. When cam ring 201 is moved downward over the body 203, the dog segments 277 are wedged further radially inward due to the direction of taper of surface 209. When cam ring 201 is moved upward, the dog segments 277 are allowed to move further radially outward by spring action. Thus, operation of dog segments 277 with respect to movement of cam ring 201 up or down over them is like the operation of dog segments 79 of mechanical connector 13 with respect to movement of sleeve 125 up or down over them.

An O-ring type seal 287 is disposed in an annular groove around the outside surface of frustoconical portion 257 of body 203, below dog segments 277. O-ring seal 287 is like O-ring seal 233.

Base plate 205 of tree cap 25 is generally triangular in configuration with a central opening therein in communication with and coaxial with cavity 261 of body 203. At each of the three corners of base plate 205, there is a hole through the plate below which and coaxial with which are attached three locking probes 207. Locking probes 207 are each secured to the base plate 205 by six bolts 289. On one side of base plate 205, a vertically extending locating pin 291 is mounted on pin base 293, which is secured to the plate 205 by bolts 295.

A plurality of U-pipe assemblies 297 are disposed on base plate 205 around the base of flange 265 of body 203. U-pipe assemblies 297 are disposed in openings through the base plate 205 and are secured to the base plate 205 by a retainer plate 299 bolted to the underside of base plate 205. Each end of each U-pipe is provided with the female half of a self-sealing Aeroquip type coupling therewithin. Typically, fifteen U-pipe assemblies 297 are provided for tree cap 25. When the tree cap 25 is installed on top of tree 11, the female halves of the Aeroquip couplings mate with male halves of Aeroquip couplings disposed in pipes located on the tree 11 to form sealed connections for tubing leading to well control apparatus, such as valve actuators, used in controlling production from the well. As the Aeroquip couplings on the U-pipes contact their corresponding male halves on the tree, check valves within the couplings are automatically unseated and Conoseal-type metal gaskets are energized to seal against leakage to the environment. If a blanking rather than a coupling function is required at any of the locations of U-pipe assemblies 297, the pipes of such assemblies are provided with blanks rather than Aeroquip couplings.

When it is desired to attach tree cap 25 to the Christmas tree 11, cap 25 is secured to its running tool 27 and lowered to the tree on drill pipe 29. Locating pin 291 is telescopically received in a sleeve on the running tool 27 to assure that the cap 25 is not attached to its running tool in an incorrect position. When the cap 25 is being lowered to the tree, cam ring 201 is held in a raised or running position by three shear pins 301 inserted through transverse passages in frustoconical surface 231 of cam ring 201 and into blind passages 303 in the upper exterior surface 285 of three of the dog segments 277, e.g., a shear pin is disposed in every other one of the six dog segments.

Figure 5A:
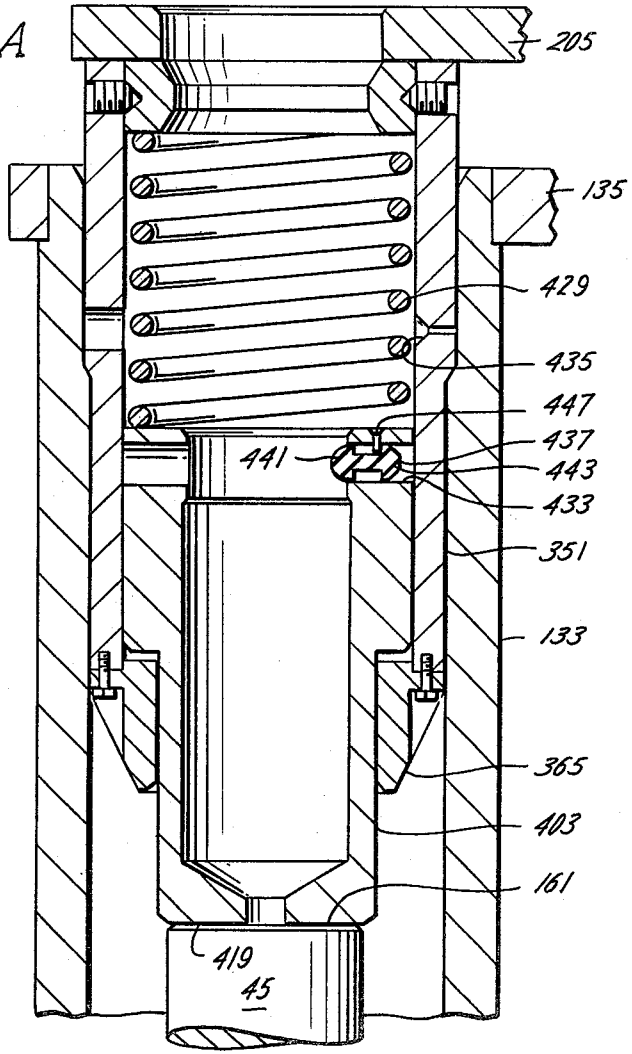
FIG. 5A is a longitudinal sectional view similar to FIG. 5 illustrating the piston of the locking probe of the tree cap of the present invention abutting the top of the mechanical connector operating rod after actuation of the piston.

When the tree cap is landed on top of the tree, the locking probes 207 are telescopically received in canisters 133, shown in FIG. 5A, attached to wye spool 15, and the upper end of wye spool 15 is telescopically received in the cavity 261 of body 203 of cap 25. The U-pipe assemblies with their female halves of the Aeroquip couplings mate with the male halves of such couplings on the tree. Ribs 279 of dog segments 277 are disposed generally opposite grooves 23 on wye spool 15, and ribs 21 of wye spool 15 are disposed generally opposite grooves 281 of dog segments 277. Cam ring 201 is forced down by the tree cap running tool, typically by hydraulic power, shearing pins 301 and sliding the internally tapered surface 209 of the cam ring 201 downward over dog segments 277. The ribs 279 and grooves 281 of dog segments 277 are wedged radially inward into locking interconnection with the wye spool's grooves 23 and ribs 21. When cam ring 201 reaches the bottom of its travel, seal 233 of cam ring 201 sealingly engages the outer surface of portion 257 of body 203, and seal 287 of body 203 sealingly engages the inner surface of bore 209 of cam ring 201. Thus, dog segments 277 are sealingly protected from adverse environmental conditions, such as the corrosive action of sea water. When cam ring 201 is forced down over dog segments 277 to lock them to the wye spool, AX-type gasket seal 273 is made up simultaneously by a camming action associated with the locking process into metal-to-metal sealing engagement with the top of wye spool 15. The camming action results from the fact that the ribs 279 and grooves 281 of dog segments 277 are in slight vertical misalignment with the grooves 23 and ribs 21 of wye spool 15 prior to actuation of dog segments 277, whereupon when dog segments 277 are pressed inward into locking connection with wye spool 15, tree cap 25 is simultaneously forced downward, providing the force necessary to make up AX-type gasket seal 273. The cap seals 233, 287 are tested by applying fluid of 5,000 p.s.i. pressure to the cap cavity through non-return valve 249 in the top of body 203, from a surface control panel via the cap running tool 27. The cap cavity is also monitored through valve 249 for well fluids leaking past crown plugs, not shown, of tree 11. Control line seals such as the Conoseal gaskets in the U-pipe couplings are tested to fluid pressures of 3,000 p.s.i. from the surface through an electro-hydraulic control module.

Figure 5:
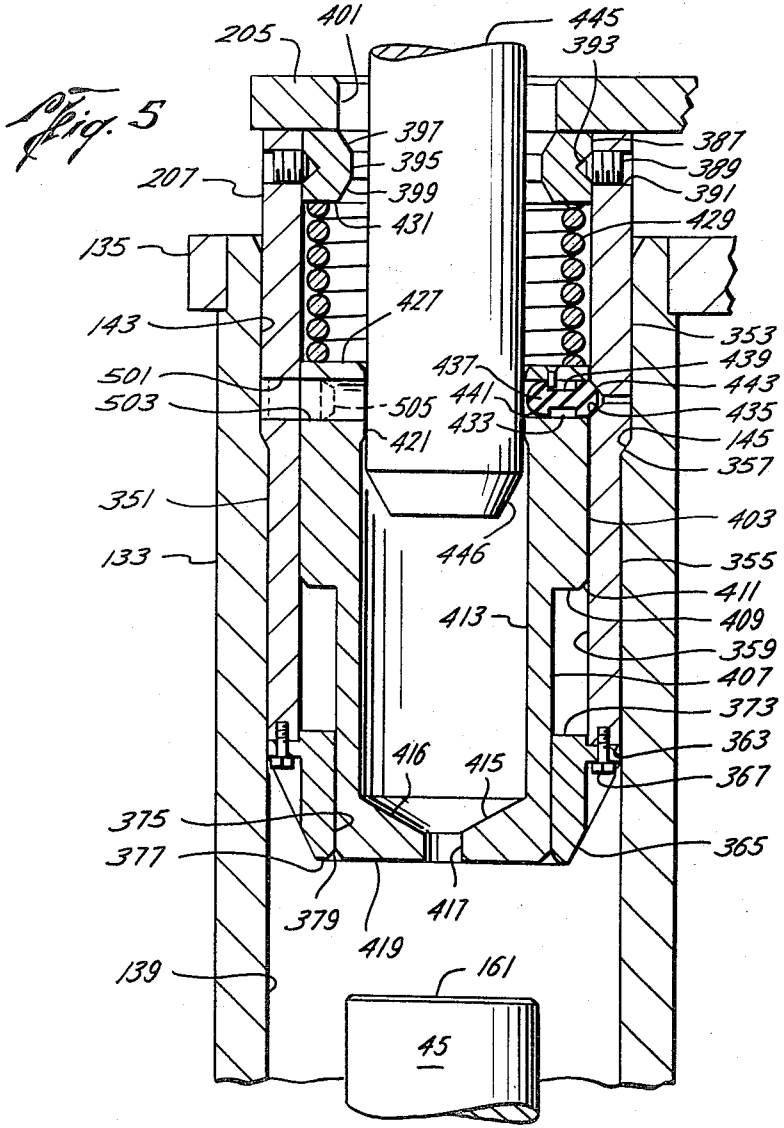
FIG. 5 is a longitudinal sectional view of one of the locking probes of the tree cap of the present invention disposed in a canister along with one of the mechanical connector operating rods prior to actuation of the piston of the locking probe, the section of the locking probe being taken along lines 5—5 of FIG. 4.

Referring to FIG. 5, there is shown one of the locking probes 207 of tree cap 25 telescopically disposed in one of the canisters 133 attached to wye spool 15. FIG. 5 illustrates the positions of probe 207, rod 45 and canister 133, after the tree cap has been landed on top of the tree and the cam ring has been actuated by the tree cap running tool, locking the cap to the tree, but prior to removal of the tree cap running tool 27 to the surface. Locking probe 207 has a generally hollow cylindrical body or housing 351 having an upper portion 353 and a lower reduced diameter portion 355 forming annular shoulder 357. Housing 351 has a central bore 359 extending the length thereof. A nose cone 365 of generally frustoconical shape is mounted to the bottom 363 of housing 351 by bolts 367 threaded into housing 351. Nose cone 365 has an internal bore 375 coaxial with and smaller in diameter than bore 359 of housing 351. At the lower end 377 of nose cone 365 there is a frustoconical shoulder 379. An annular flange 373 projecting upwardly from cone 365 is slidingly received within central bore 359.

The upper counterbore 143 and bore 139 of canister 133 are dimensioned so as to receive and slidingly engage portions 353, 355 of housing 351 of probe 207.

Shoulder 357 of housing 351 rests upon shoulder 145 of canister 133, shoulders 357, 145 providing a limit to downward travel of locking probe 207 within canister 133.

At the upper end of housing 351, an annular collar 387 is disposed within bore 359 and is retained therein by screws 389 threadedly disposed in transverse passages 391 through housing 351 and extending into transverse recesses 393 in the peripheral surface of collar 387. Collar 387 has a central aperture 395 therein and upper and lower frustoconical shoulders 397, 399, respectively, which are in communication with and coaxial to hole 401 in base plate 205.

A cylindrical piston 403 is telescopically disposed within central bore 359 of housing 351. Piston 403 has a lower reduced diameter portion 407 forming annular shoulder 409, portion 407 being slidingly received by bore 375 of nose cone 365. The outer periphery of shoulder 409 is beveled, at 411.

Piston 403 has an internal central bore 413 and a closure cap 416 at its bottom forming an inwardly tapering conical surface 415. Closure cap 416 includes a bleed passage 417 from the bottom of surface 415 to the lower end 419 of piston 403. An annular flange 421, having an internal diameter smaller than bore 413, extends inwardly from the upper end of piston 403.

A coil spring 429 is disposed in compression between the bottom face 431 of collar 387 and the top end 427 of piston 403.

Figure 4:
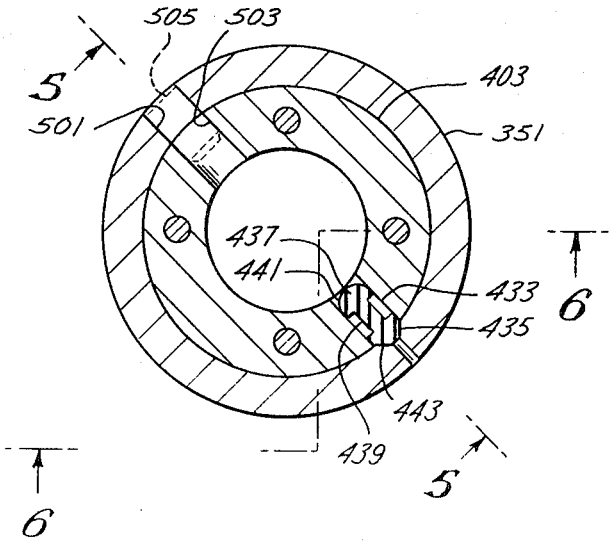
FIG. 4 is a transverse sectional view of one of the locking probes of the tree cap of the present invention, taken along section lines 4—4 of FIG. 3.

Referring also to FIG. 4, transverse passage 433 extends through the upper portion of piston 403. A recess 435 is formed in the inside surface of upper portion 353 of housing 351. A double-headed trigger 437 is slideably disposed in passage 433. Trigger 437 includes a shaft 439 with blunt head 441 attached to its inside end and frustoconical head 443 attached to its outside end. The outer end of head 443 is disposed in recess 435 in the wall of housing 351.

A cylindrical actuating pin 445 mounted on tree cap running tool 27 extends through hole 401 in plate 205, through the central aperture 395 in collar 387, through coil spring 429, and is slidingly received in the aperture in annular flange 421 of piston 403 for insertion into bore 413. Pin 445 has a frustoconical bottom 446. Upon the insertion of pin 445 into the aperture in flange 421, the inside end of head 441 of trigger 437 abuts the frustoconical surface 446 of the pin 445 camming trigger 437 outwardly into recess 435. With the end of head 443 of trigger 437 disposed in recess 435 in the wall of housing 351 and the end of head 441 of trigger 437 abutting pin 445, piston 403 is restrained from being forced downward by spring 429.

When pin 445 is withdrawn from the inside of locking probe 207, i.e., when tree cap running tool 27 is removed to the surface, trigger 437 is free to move radially inward. The downward force exerted on the top of piston 403 by spring 429 is transmitted through the piston body to the frustoconical head 443 of trigger 437 and the walls of recess 435. The radial component of this force causes trigger 437 to slide radially inward in passage 433, such that head 443 of trigger 437 is cammed out of and removed from recess 435. Removal of head 443 of trigger 437 from recess 435 eliminates the restraint on downward movement of piston 403, and piston 403 is pushed downward by spring 429 until the bottom end 419 of piston 403 abuts the top end 161 of operating rod 45.

FIG. 5A illustrates the positions of piston 403, spring 429 and trigger 437 after actuation of piston 403. The bottom end 419 of piston 403 abuts the top end 161 of rod 45. Spring 429 has been longitudinally extended a distance such that it maintains its downward force against the top of piston 403. Spring 429 does not, however, push down on the top of piston 403 with sufficient force to push rod 45 down any farther than it was prior to actuation of piston 403. Trigger 437 is prevented from being completely expelled radially into the bore of piston 403 by a retaining screw 447 which is threadedly disposed in a longitudinal passage extending from the top end of piston 403 to transverse passage 433. Retaining screw 447 extends into passage 433 and between heads 441, 443 of trigger 437 a sufficient distance to prevent head 443 from passing radially inward beyond retaining screw 447.

Figure 6A:
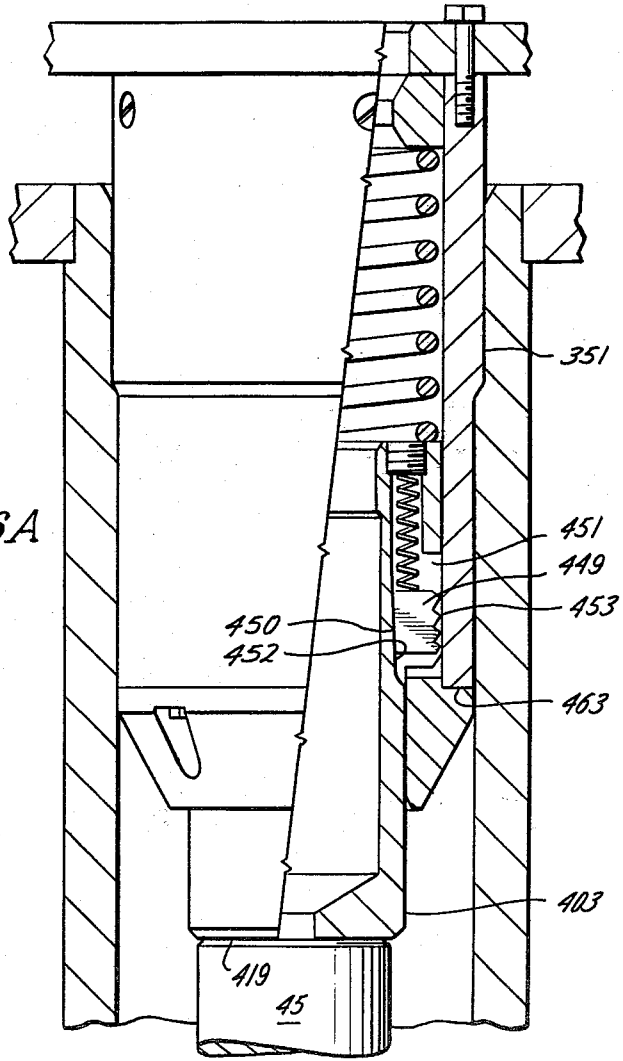
FIG. 6 is a view, partially in longitudinal section and partially in elevation, of one of the locking probes of the tree cap of the present invention disposed in a canister along with one of the mechanical connector operating rods prior to actuation of the piston of the locking probe, with a section of the locking probe being taken along lines 6—6 of FIG. 4 to show one of the dog segments carried by the piston; and, FIG. 6A is a view, partially in longitudinal section and partially in elevation, similar to FIG. 6 illustrating the position of the piston and dog segments after actuation of the piston.
Figure 6:
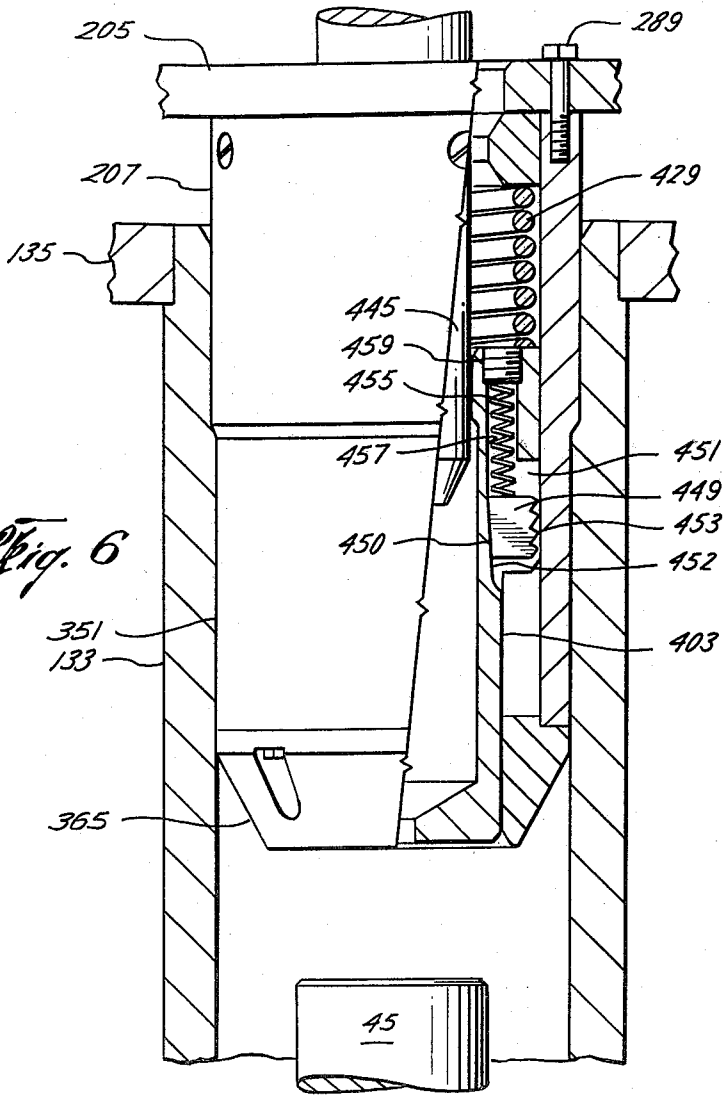

Referring to FIG. 6, there is shown another view of one of the locking probes 207 disposed in canister 133 prior to actuation of the piston 403. Each piston 403 carries a set of four equally circumferentially spaced apart dog segments 449 disposed in recesses 451 in the walls of piston 403. Dog segments 449 have outwardly, upwardly facing teeth 453 on their outside faces which bear upon the inside surface of the walls of housing 351 of locking probe 207. The inside faces 450 of dog segments 449 abut the back walls 452 of recesses 451. The inside faces 450 of dog segments 449 are tapered inward from the bottoms of the dog segments upward, and the back walls 452 of recesses 451 are correlatively tapered. A coil spring 455 in compression extends from the top of each dog segment 449 through a longitudinal passage 457 in piston 403 to a cap screw 459. Cap screws 459 are threadedly disposed in longitudinal passages extending from the top end of piston 403 to passages 457. Springs 455 exert a force upon dog segments 449, tending to push them downward.

After actuation of the piston 403 by removing pin 445 from within the locking probe 207, dog segments 449 are forced downward by springs 455 as piston 403 is forced downward into abutment with rod 45 by spring 429. As shown in FIG. 6A, after actuation of piston 403, dog segments 449 are disposed near the bottom end 463 of housing 351 but remain entirely within housing 351. If an upward force is exerted upon the bottom end 419 of piston 403, teeth 453 of dog segments 449 will bite into the internal surface of the walls of housing 351 due to the shape of the teeth and the wedging action of tapered walls 452 of recesses 451 attempting to slide upward with respect to the correlatively tapered faces 450 of dog segments 449. When teeth 453 of dog segments 449 bite into the walls of housing 351, upward travel of piston 403 is prevented. Thus, rods 45 cannot move upward once piston 403 is actuated, since the top of each rod abuts the bottom end of a piston which itself cannot be forced upward due to the gripping and wedging action of dog segments 449. Pistons 403 when actuated thereby provide a positive lockdown for rods 45, preventing their upward movement and consequent loosening of the connection between Christmas tree 11 and wellhead housing 7.

In assembling the locking probe 207 with their spring loaded piston 403, nose cones 365 are first attached to the bottoms of housings 351. Trigger 437 and retaining screw 447 are mounted on the piston 403, and locking dogs 449 are set in place in their recesses 451. Piston 403 is then inserted into housing 351 such that a transverse passage 501 (FIGS. 4 and 5) through the wall of housing 351 aligns coaxially with a corresponding transverse passage 503 in the wall of piston 403. When passages 501, 503 are so coaxially aligned, passage 433 in piston 403 is coaxially aligned with recess 435 in housing 351. A slave screw 505, shown in phantom outline in FIGS. 4 and 5, is then inserted into passages 501, 503 such that it extends into passage 503 while remaining partially in passage 501, thereby preventing vertical movement of piston 403 in housing 351. Springs 455 are then inserted into their passages and cap screws 459 are installed, compressing springs 455. Spring 429 is then placed atop piston 403 and compressed with the aid of a compression tool, not shown, and collar 387 with retaining screws 389 is installed atop compressed spring 429. When tree cap 25 is installed on running tool 27 for lowering to the wellhead, triggers 437 are cammed by pins 445 of tool 27 radially outward into recesses 435 in housings 351 of locking probes 207. With triggers 437 restrained in recesses 435 and channels 433 by pins 445, slave screws 505 are removed and piston 403 is then in a cocked or loaded state, ready to spring downward when pins 445 are withdrawn.

When it is desired to remove Christmas tree 11 from the wellhead, e.g., for repairs to the tree or the well, tree cap running tool 27 is lowered to tree 11, cam ring 201 is lifted by running tool 27, typically hydraulically, thereby releasing dog segments 277 from wye spool 15. Cap 25 is then removed by lifting it vertically, the locking probes 207 being removed from canisters 133 and exposing the tops of rods 45 to access by a tree running tool, not shown. The tree running tool is then lowered to tree 11 and rods 45 are grasped and pulled upward by the tool, typically by hydraulic power, thereby releasing dog segments 79 from wellhead housing 7, as described previously.

All major metal components of tree cap 25, e.g., cam ring 201, body 203, base plate 205 and locking probe housing 351 and piston 403, may be constructed of an alloy steel such as AISI 4130 steel. The parts of tree cap 25 exposed to sea water may be coated with a protective finish such as epoxy paint. Moving parts, such as dog segments 277, 79 should be lubricated with a durable lubricant such as, for example, Shell salt-resistant chassis grease.

Because many varying and different embodiments may be made within the scope of the inventive concept herein taught, and because many modifications may be made in the embodiment herein detailed, it should be understood that the details described herein are to be interpreted as illustrative and not in a limiting sense.

I claim:

1. An apparatus for an actuator which actuates a connector for connecting one end of a tubular member to an underwater wellhead, comprising:

mechanical means for mechanically maintaining the actuator in the actuated position to insure the connection of the tubular member to the wellhead, said mechanical means including extension means for extending into engagement with said actuator to prevent said actuator from moving to a nonactuated position, said extension means including a piston slidably disposed within a cylinder and activation means for extending said piston from said cylinder whereby said piston engages the actuator preventing the actuator from moving to a nonactuated position.

2. The apparatus of claim 1 wherein said activation means includes biasing means for biasing said piston from said cylinder and release means for releasing said biasing means to bias said piston.

3. The apparatus of claim 2 wherein said release means includes a latch for latching engagement between said piston and cylinder and pin means for causing said latch to release engagement with said cylinder.

4. The apparatus of claim 1 wherein said extension means includes holddown means for holding said piston in engagement with the actuator.

5. An apparatus for an actuator which actuates a connector for connecting one end of a tubular member to an underwater wellhead, comprising:

mechanical means for mechanically maintaining the actuator in the actuated position to insure the connection of the tubular member to the wellhead, and a cap for the other end of said tubular member and attachment means for attaching said cap to said tubular member.

6. The apparatus of claim 5 wherein said mechanical means is disposed on said cap.

7. The apparatus of claim 5 wherein said attachment means includes dog segments radially housed within said cap and cam means for camming said dog segments into engagement with said tubular member.

8. The apparatus of claim 5 further including seal means for sealing between said cap and said tubular member.

9. The apparatus of claim 8 further including means for testing said seal means.

10. The apparatus of claim 5 further including means for lowering said cap to said tubular member and for actuating said attachment means and means for releasing said lowering and actuating means.

11. An underwater well apparatus for connection of flowlines to an underwater wellhead, comprising:

a tubular member adapted for connection with the flowlines;

connection means for connecting one end of said tubular member to the wellhead;

an actuator for actuating said connection means by moving from a nonactuated position to an actuated position; and mechanical means for mechanically maintaining said actuator in said actuated position to insure the connection of said tubular member to said wellhead, said actuator including a plurality of rods attached to a cam plate for camming dog segments into engagement with said wellhead upon the downward movement of said rods into said actuated position.

12. An underwater well apparatus for connection of flowlines to an underwater wellhead, comprising:

a tubular member adapted for connection with the flowlines;

connection means for connecting one end of said tubular member to the wellhead;

an actuator for actuating said connection means by moving from a nonactuated position to an actuated position; and mechanical means for mechanically maintaining said actuator in said actuated position to insure the connection of said tubular member to said wellhead, said mechanical means being mounted on the other end of said tubular member and including a plurality of probes for engagement with said actuator.

13. The apparatus of claim 12 further including a cap and attachment means for attaching said cap to the other end of said tubular member.

14. The apparatus of claim 13 wherein said mechanical means is mounted on said cap for attachment to said tubular member.

15. The apparatus of claim 12 wherein said actuator includes an actuator member having a plurality of rods extending therefrom.

16. The apparatus of claim 15 further including a plurality of canisters disposed on said other of said ends of said tubular member each receiving an unattached end of one of said rods.

17. The apparatus of claim 16 wherein each of said canisters receives one of said probes.

18. The apparatus of claim 17 wherein each of said probes have extension members reciprocably mounted therein and actuation means for moving said extension members into engagement with said rods to maintain said rods and actuator member in said actuated position.

19. The apparatus of claim 18 wherein said rods are at different vertical positions and said extension members include means for engaging the ends of said rods at said different vertical positions.

20. The apparatus of claim 17 wherein each of said canisters includes stop means for limiting the reception of said probes therein.

21. The apparatus of claim 20 wherein said dog segments are reciprocably mounted within a housing disposed on said end of said tubular member and receiving a portion of said wellhead, said cam plate being reciprocably mounted within a housing disposed on said end of said tubular member and receiving a portion of said dogs; said rods extending from said housing adjacent said tubular member.

22. A cap for an underwater Christmas tree releasably connected to an underwater wellhead housing by a mechanical connector, such mechanical connector having an operating rod mechanically movable between a first position actuating the connector and a second position releasing the connector, comprising:

a body;

means disposed on said body for attaching said body to the top of such Christmas tree;

engagement means depending from said body for engaging such rod when such rod is in such first position; and locking means carried by said engagement means for locking said engagement means in engaged position and preventing such rod from moving from such first position to such second position.

23. Cap according to claim 22, said engagement means including a locking probe, said locking probe including:

a cylinder;

a piston telescopically slidably disposed in said cylinder, said piston being movable from a loaded position out of engagement with such rod to an actuated position in engagement with such rod;

releasable latch means for releasably holding said piston in said loaded position; and actuating means for actuating said piston into engagement with such rod upon release of said releasable latch means.

24. Cap according to claim 23, wherein said releasable latch means includes a trigger member reciprocably disposed in a transverse passage in said piston, one end of said trigger member being received in a recess in the wall of said cylinder when said piston is in said loaded position.

25. Cap according to claim 24, wherein said piston includes an internal central bore, said passage extending through the wall of said piston, and including removable retaining means in said bore for bearing against the other end of said trigger member when said piston is in said loaded position for preventing movement of said trigger member out of said recess.

26. Cap according to claim 25, further including correlatively shaped cooperable wedging surfaces on said one end of said trigger member and said recess, said wedging surfaces being slidable over one another for forcing said trigger member out of said recess upon removal of said retaining means from said bore and application of an axial force on said piston.

27. Cap according to claim 26, wherein said actuating means includes spring means disposed in said cylinder and engaging said piston for biasing said piston toward said actuated position and applying such axial force thereon.

28. Cap according to claim 27, wherein said locking means includes at least one dog carried by said piston for lockingly engaging the wall of said cylinder when said piston is in said actuated position and preventing said piston from moving out of engagement with such rod.

* * * * *

UNITED STATES PATENT AND TRADEMARK OFFICE

CERTIFICATE OF CORRECTION

PATENT NO. : 4,405,016

DATED : SEPTEMBER 20, 1983

INVENTOR(S) : MICHAEL J. A. BEST

It is certified that error appears in the above—identified patent and that said Letters Patent is hereby corrected as shown below:

Column 2, line 26; change "tee" to --tree--.

Column 5, line 17; change "48" to --49--.

Signed and Sealed this

*Sixth* Day of *March 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,405,016

DATED : SEPTEMBER 20, 1983

INVENTOR(S) : Michael J. A. Best

It is certified that error appears in the above—identified patent and that said Letters Patent is hereby corrected as shown below:

In the first line of Claim 21, column 15, line 29: change "20" to --11--.

Signed and Sealed this

*Twelfth* Day of *June 1984*

[SEAL]

*Attest:*

GERALD J. MOSSINGHOFF

*Attesting Officer*

*Commissioner of Patents and Trademarks*